US007806300B1

(12) United States Patent
Noell et al.

(10) Patent No.: US 7,806,300 B1
(45) Date of Patent: Oct. 5, 2010

(54) HYDRATION SYSTEM

(75) Inventors: Michael M. Noell, Norfolk, VA (US); Jeffrey S. Skillern, Boise, ID (US); Eric M. Yeates, Virginia Beach, VA (US); Clifton L. Cook, Boise, ID (US); Thomas M. Gregory, Virginia Beach, VA (US); Matt M. McCune, Bozeman, MT (US); Thomas A. Marx, Virginia Beach, VA (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 0 days.

(21) Appl. No.: 11/982,683

(22) Filed: Nov. 2, 2007

Related U.S. Application Data

(63) Continuation-in-part of application No. 10/821,574, filed on Apr. 9, 2004, now Pat. No. 7,311,231.

(51) Int. Cl.
*B67D 7/84* (2010.01)

(52) U.S. Cl. ..... 222/175; 224/148.2

(58) Field of Classification Search ..... 222/175, 222/526–530, 94, 129; 224/158.2, 148.1, 224/148.2, 148.4–148.6; 220/705, 714
See application file for complete search history.

(56) References Cited

U.S. PATENT DOCUMENTS 5,715,863 A * 2/1998 Paczonay ..... 137/512
5,806,726 A * 9/1998 Ho ..... 222/529
6,039,301 A * 3/2000 Westerhof ..... 251/144
6,126,045 A * 10/2000 Last ..... 222/501
6,722,533 B2 * 4/2004 Skillern ..... 222/175
6,749,090 B2 * 6/2004 Bailey ..... 222/175
2002/0113101 A1 * 8/2002 Skillern ..... 224/148.2
2006/0071006 A1 * 4/2006 Lojkutz et al. ..... 220/705

* cited by examiner

*Primary Examiner*—Lien T Ngo
(74) *Attorney, Agent, or Firm*—Bowman Green Hampton & Kelly, PLLC

(57) ABSTRACT

A hydration system that includes a flexible reservoir coupled to a self-sealing port assembly, wherein an interior of the flexible reservoir is in fluid communication with the port assembly; a delivery conduit having two ends, wherein a first end of the delivery conduit is coupled to a self-sealing connector assembly and wherein a second end of the delivery conduit is coupled to an end fitting; a user actuable valve removably coupled to the self-sealing connector assembly; and wherein the port assembly is open to allow fluid to flow from the flexible reservoir when the end fitting of the delivery conduit is coupled to the port assembly and the port assembly is closed to prevent fluid from flowing from the flexible reservoir when the end fitting of the delivery conduit is decoupled from the port assembly, such that the reservoir may be disconnected from the delivery conduit without leakage.

9 Claims, 11 Drawing Sheets

HYDRATION SYSTEM

CROSS-REFERENCE TO RELATED APPLICATIONS

This is a Continuation-In-Part of U.S. patent application Ser. No. 10/821,574, filed Apr. 9, 2004 now U.S. Pat. No. 7,311,231, the disclosure of which is incorporated herein by reference.

BACKGROUND OF THE INVENTION

1. Field of the Invention

This invention relates generally to hydration systems. In particular, the present invention relates to portable, bladder-type hydration systems.

2. Description of Related Art

Numerous hydration systems have been conceived in effort to effectively and conveniently quench the thirst of military personnel, hikers, cyclist, and other athletes or hobbyist who need to pack or carry a personal water supply. Many have chosen to abandon the concept of a separate water bottle that is mounted in a cages attached to a bicycle frame or carried in an external pocket or pouch of a backpack in favor of using a hydration reservoir.

A popular class of hydration reservoir products set a reservoir in a backpack, whereby access to the liquid contents of the reservoir is achieved by a hose running from the base of the reservoir to the mouth of a user. A bite valve is usually included at the end of the hose so the user can obtain the liquid without involving his or her hands.

Backpack carried hydration reservoirs have gained acceptance for reason of the large volume of drinking fluid they may contain, as compared to a traditional water bottle. Of equal importance, however, is the manner in which hydration reservoirs carry the drinking fluid. The flexible nature of the hydration reservoir allows the reservoir carried on the user's back to conform in shape to the backpack or other contents of the backpack. Additionally, the reservoir is able to collapse as the liquid is drained from it.

Most often, water bottles are substantially rigid and generally cylindrical. While they may be compressed to squeeze out their contents, they typically return to their previous shape.

SUMMARY OF THE INVENTION

The present invention comprises a flexible hydration reservoir, or bladder, a delivery tube, or conduit, removably attached to the hydration reservoir and a bite valve removably attached to the delivery conduit. In various exemplary, non-limiting embodiments, the delivery conduit is attached to the reservoir via a port assembly and the bite valve is attached to the delivery conduit via a connector assembly. Each of the port assembly and the connector assembly includes a shut-off or check valve, which is capable of closing to maintain fluid within the reservoir or the delivery conduit, respectively, when the delivery conduit is disconnected or decoupled from the reservoir or the bite valve is disconnected or decoupled from the delivery conduit.

In certain exemplary embodiments, one or more additional valves may also be provided to hold fluid in the delivery conduit when portions of the delivery conduit are disengaged. In various exemplary embodiments, the port assembly is integral to the reservoir. Alternately, the port assembly may be provided in-line with the delivery conduit.

Thus, the inventive system operates such that when the delivery conduit is coupled to the reservoir, via the port assembly, the port assembly automatically opens such that liquid within the reservoir is able to flow through the delivery conduit, via the port assembly. When the bite valve is coupled to the delivery conduit, via the connector assembly, the connector assembly automatically opens such that liquid within the delivery conduit is able to flow through the bite valve, via the connector assembly.

However, when the delivery conduit is decoupled from the reservoir, the port assembly automatically closes such that liquid within the reservoir does not escape through the port assembly. Likewise, when the bite valve is decoupled from the delivery conduit, the connector assembly automatically closes such that liquid within the delivery conduit does not escape through the delivery conduit.

In this manner, the decoupled reservoir then may be removed from a backpack, refilled, chilled, cleaned, or otherwise attended to. Filling of the reservoir is feasible in view of the shutoff valve provided to maintain the contents of the reservoir without the closure typically offered by a delivery conduit with a bite valve.

In addition, the disclosed coupling/check-valve combination offers a potential for certain modularity. For example, a user is able to use one delivery conduit and bite valve combination with any number of reservoirs that may vary in size or features.

In various exemplary embodiments, the reservoir includes at least one thermal medium contained within at least one thermal capacitance medium reservoir.

The integral thermal medium, if included, may be used as a cooling medium or a heating medium.

In one exemplary embodiment, the present invention is directed to a hydration system, which includes a flexible reservoir having fluid therein, the reservoir having an outlet that is in communicating relationship with a port assembly, for passing fluid from the reservoir when a delivery conduit is appropriately coupled to the port assembly. The delivery conduit includes two ends and is capable of being removably coupled to the port assembly at one end, via an end fitting, and removably coupled to a bite valve at an end distal from the port assembly. When the end fitting of the delivery conduit is coupled to the port assembly, the port assembly opens such that fluid is able to flow into or out of the flexible reservoir. When the end fitting of the delivery conduit is decoupled from the port assembly, the port assembly closes such that fluid is maintained within the flexible reservoir.

In various exemplary embodiments, the outlet/port assembly is positioned substantially near the bottom of the flexible reservoir. The flexible reservoir may include baffles for shape retention when the reservoir is filled and as the reservoir is emptied.

In certain exemplary embodiments, the flexible reservoir may comprise two or more separate compartments, such that separate fluids may be carried in each compartment or so that a single fluid may be carried in multiple compartments.

Thus, in various exemplary embodiments, the hydration system of the present invention allows a person to releasably couple the end fitting of a delivery conduit to a port assembly of a first prefilled, flexible reservoir having a potable liquid therein, such that the liquid can be communicated through the delivery conduit. When the liquid is consumed from the reservoir, or whenever the individual wishes, the end fitting of the delivery conduit can be decoupled or released from the port assembly of the first, prefilled reservoir and releasably connected to a port assembly of a second, prefilled reservoir.

In various other exemplary embodiments, the reservoir of the present invention includes a sealable or resealable opening through which the reservoir may be filled. Thus, when a liquid is consumed from the reservoir, the reservoir can be refilled.

In the case of either a prefilled or a fillable reservoir, when a delivery conduit is connected to port assembly of the reservoir, the reservoir can be filled or refilled, via fluid flowing through the delivery conduit into the reservoir.

Accordingly, this invention provides a hydration system of improved design.

This invention separately provides a hydration system, which is capable of allowing a user to connect, disconnect, and manipulate the elements of the system without liquid leaking from the reservoir or the delivery conduit.

This invention separately provides a hydration system, which is capable of allowing a single bite valve/delivery conduit combination to be used with multiple reservoirs.

While any of these enumerated advantages are possible, it may be the case that none or only some of these specific advantages are made use of in connection with the present invention. Furthermore, those with skill in the art may appreciate other advantages not expressly mentioned herein.

Whatever the case, the present invention includes systems comprising any of the features described herein. Methodology described in association with the disclosed systems, methods, apparatuses, and devices also forms part of the invention.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF THE INVENTION

Figure 1:
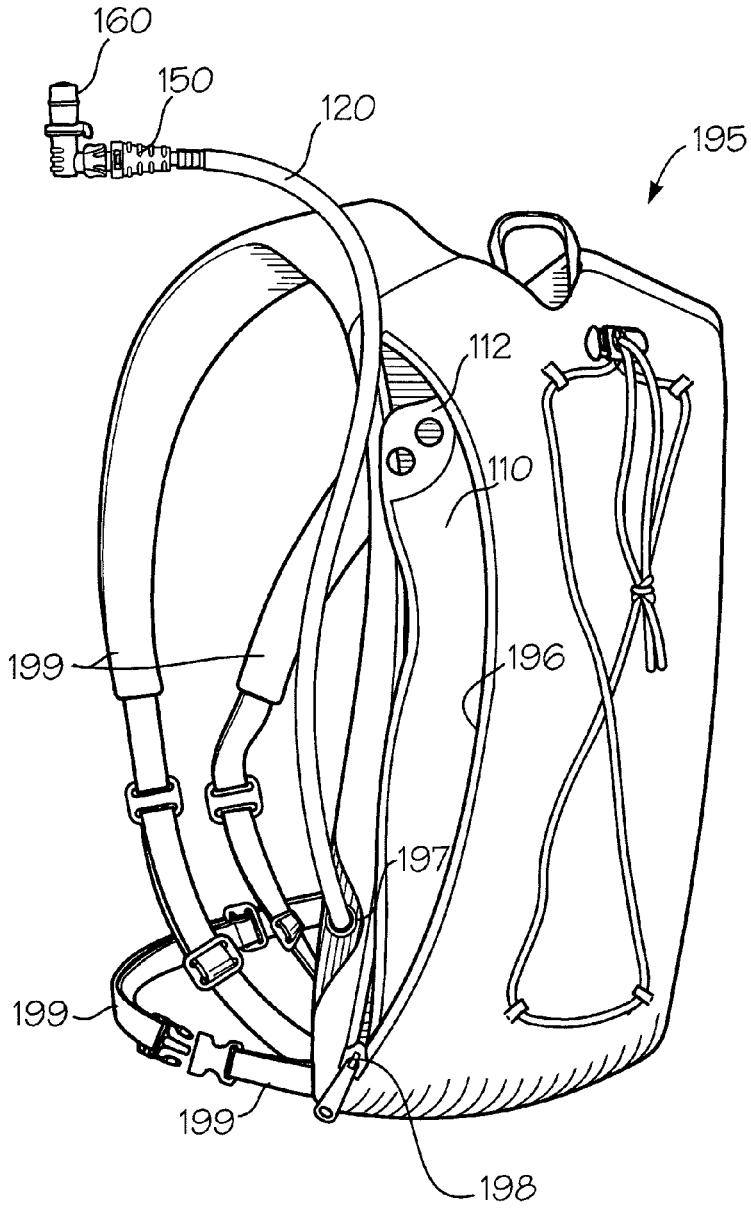
FIG. 1 shows a perspective view of a hydration system of the present invention, wherein the hydration system is incorporated into an exemplary backpack.

Before describing variations of the present invention in detail, first, it is to be understood that this invention is not limited to particular variations set forth and may, of course, vary. Various changes may be made to the invention described and equivalents may be substituted without departing from the true spirit and scope of the invention. In addition, modifications may be made to adapt a particular situation, material, composition of matter, process, process step, or steps, to the objective, spirit, and scope of the present invention. All such modifications are intended to be within the scope of the claims made herein.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either both of those included limits are also included in the invention.

Also, it is contemplated that any optional feature of the inventive variations described herein may be set forth and claimed independently, or in combination with any one or more of the features described herein.

Unless defined otherwise, all technical and scientific terms used herein have the same meaning as commonly understood by one of ordinary skill in the art to which this invention belongs. However, it should be appreciated that exemplary, non-limiting methods and materials are described herein and any methods and/or materials similar or equivalent to those described herein can also be used in practicing the present invention, the preferred methods and materials are described. All existing subject matter mentioned herein (e.g., publications, patents, patent applications, and hardware) is incorporated by reference herein in its entirety. The referenced items are provided solely for their disclosure prior to the filing date of the present application. Nothing herein is to be construed as an admission that the present invention is not entitled to antedate such material by virtue of prior invention.

Also, it is noted that as used herein and in the appended claims, the singular forms "a", "and", "said" and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

Furthermore, it should be appreciated that, for simplicity and clarification, the embodiments of this invention will be described with reference to the terms "pouch", "reservoir", "bag", "tube", "hose", and/or "delivery conduit" are used for basic explanation and understanding of the operation of the systems, methods, and apparatuses of this invention. Therefore, the terms "pouch", "reservoir", "bag", "tube", "hose", and/or "delivery conduit" are not to be construed as limiting the systems, methods, apparatuses, and applications of this invention.

Figure 2:
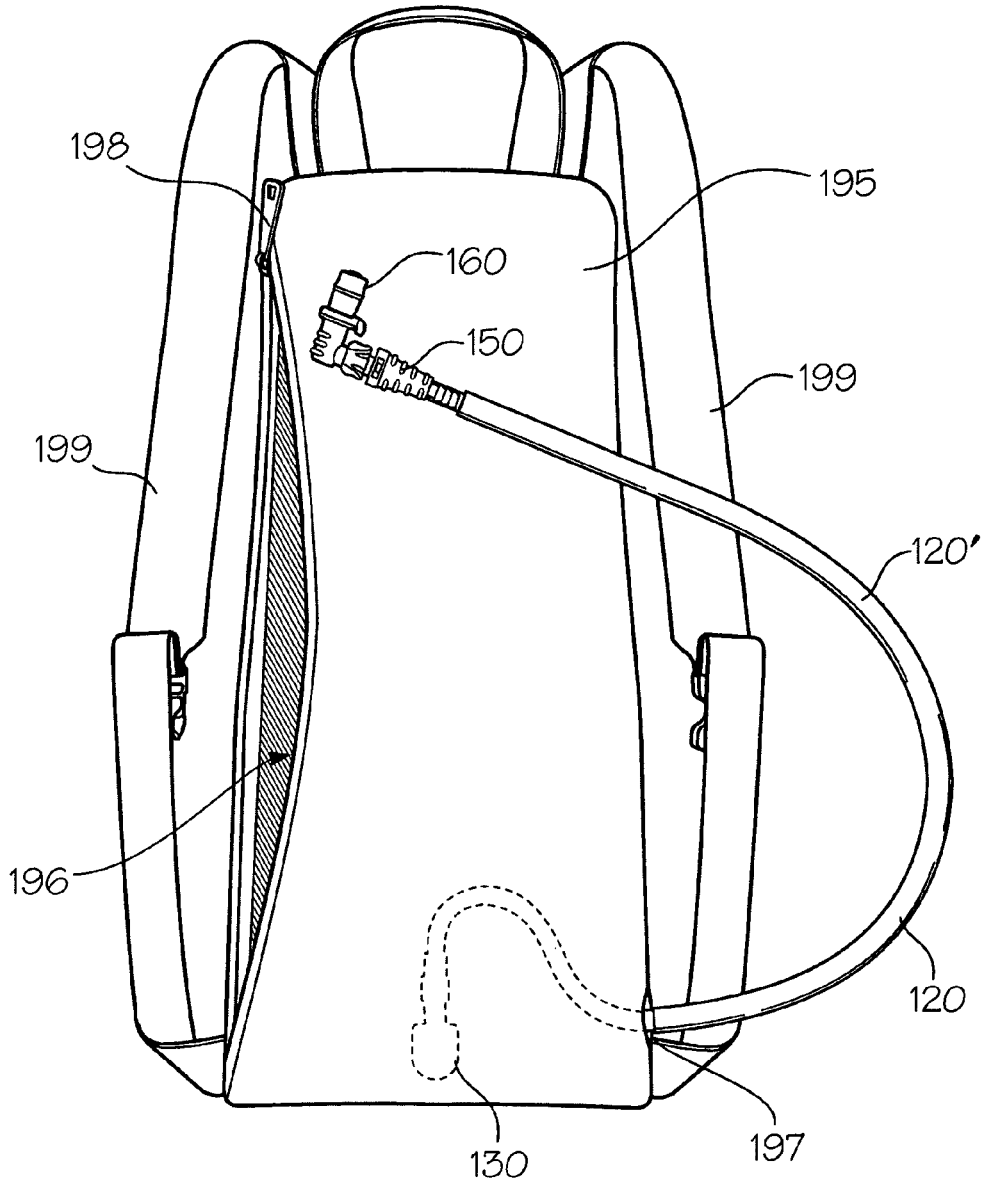
FIG. 2 shows a rear view of an additional exemplary embodiment of the hydration system of the present invention, where in the hydration system is incorporated into an exemplary backpack.

Turning now to FIGS. 1 and 2, the hydration system of the present invention may include or be included in a backpack 195 adapted to house a reservoir 110. In various exemplary embodiments, the backpack 195 may be similar to those manufactured and are produced by Blackhawk Products Group (Norfolk, Va.) under their hydration compatible line of backpacks.

Backpack 195 includes a reservoir compartment 196 with an access zipper 198 for providing access to the reservoir compartment 196 and straps 199. FIGS. 1 and 2 show the reservoir 110 within the backpack 195. The reservoir 110 is removably affixed within the reservoir compartment 196 of the backpack 195. The delivery conduit 120 attaches at one end to the reservoir via an end fitting 140 (represented in phantom in FIG. 2) and passes through an opening 197 in the reservoir compartment 196 to an exterior of the backpack 195.

Typically, the delivery conduit 120 is threaded from the inside of the reservoir compartment 196 to the outside of the backpack 195 as shown. It should be understood that the delivery conduit 120 may pass through or be tied down by various members in order to confine its path while in use or for storage.

In various exemplary embodiments, the delivery conduit 120 may be insulated or include an insulating delivery conduit cover 120'. For example, a neoprene sleeve, such as produced by Blackhawk Products Group (Norfolk, Va.) may be used.

A bite valve 160 is coupled, via a self-sealing, connector assembly 150, at an end of delivery conduit 120 distal from the reservoir 110. In various exemplary embodiments, the bite valve 160 is operable for activation by the jaws and teeth of a user. Once activated, the bite valve 160 allows fluid to flow. Otherwise, the bite valve 160 is closed and prevents inadvertent draining of the reservoir 110.

The ability to detach reservoir 110 from the delivery conduit 120 can tremendously expedite reservoir placement, change-out, and hydration system preparation. Thus, the functional value of being able to release and install the reservoir 110 separate from the delivery conduit 120 becomes apparent. Replacing an empty hydration reservoir with a full one, or returning a filled reservoir (neither one being connected to a capped delivery conduit or line in accordance with the present invention) to backpack 195 is feasible due to the port assembly 100, which keeps the contents of the reservoir 110 intact without resort to holding the reservoir 110 at an awkward angle or manually stopping any openings with a finger or the like.

Handling of a detached reservoir 110 is improved over one attached to a hydration line in another respect. A detached reservoir 110 may be stored, refrigerated, warmed, or filled without a user getting tangled in a lengthy piece of tubing. In addition, other advantages and uses may be apparent to one with skill in the art.

Accordingly, the user may remove an empty or nearly empty reservoir 110 from the reservoir compartment 196 and easily replace it with a filled reservoir. Thus, in various exemplary embodiments, the present invention allows prefilled, disposable reservoirs to be quickly and easily removed and replaced without leakage. That is, while the reservoir 110 may be used for repeated filling and reuse by a consumer, the reservoir 110 may be formed and prefilled for disposal after a single use.

Although a durable, reusable reservoir may be preferred in many environments, certain situations call for the convenience of a prefilled, replaceable, disposable reservoir. For example, in military applications a large number of soldiers can more quickly receive prefilled reservoirs from a central stock and replace and dispose of used reservoirs than they can refill reusable reservoirs. Other situations in which prefilled, disposable reservoirs may be preferred include sporting events with a large number of participants and activities in regions where potable water is inaccessible or not easily accessible. Alternatively, premium fitness waters or sports drinks may be provided in prefilled disposable reservoirs for consumption by individual users in accordance with the present invention.

The reservoir 110 is generally formed by two or more heat-sealed or welded layers. In various exemplary embodiments, at least certain portions of the reservoir 110 that are intended to contact fluid for drinking comprise such materials as commonly used in other flexible hydration reservoirs, bags, pouches, bladders, or the like. Suitable materials include, but are not limited to polyethylene, urethane, polyurethane, polystyrene, and nylon.

The self-sealing, port assembly 130 allows for removal and replacement of the reservoir 110 without leakage from the reservoir 110. An exemplary mechanism for the port assembly 130 is discussed in greater detail below. It should be noted that, as with disposable plastic water bottles, although the present prefilled embodiments of the reservoir 100 are disposable, the individual consumer may advantageously refill and reuse the reservoir several times by filling the reservoir 110 through delivery conduit 120 and port assembly 130. The present port assembly 130 allows for flow of fluid into the reservoir 110 upon engagement of the coupler.

Figure 3:
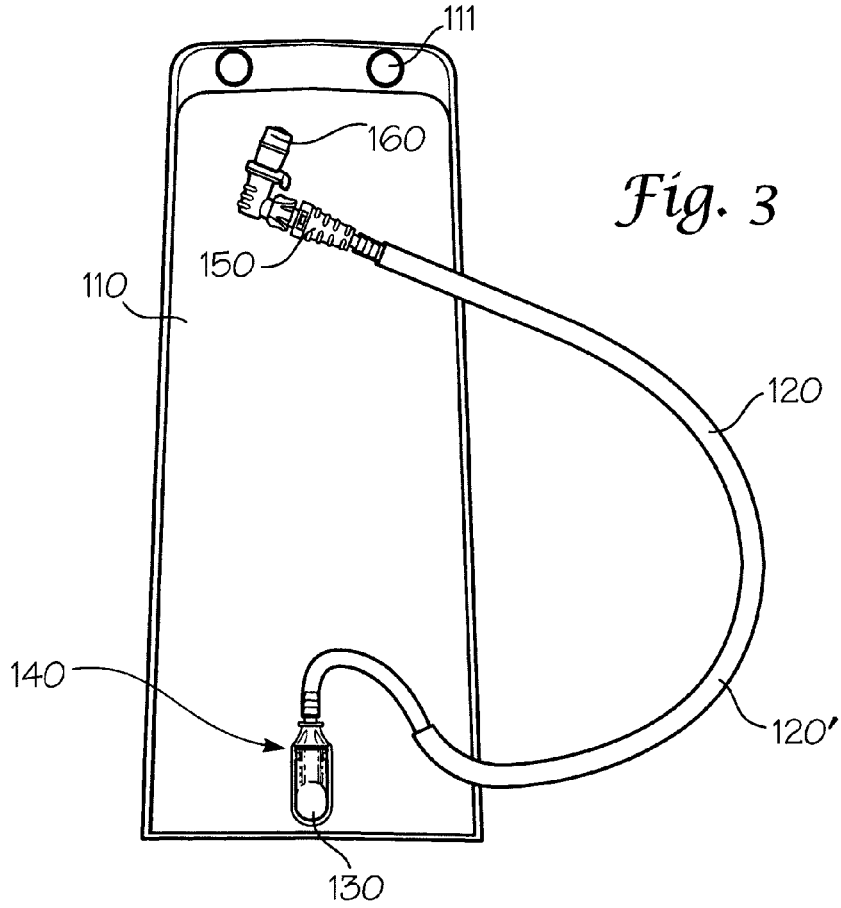
FIG. 3 shows a plan view of an exemplary reservoir for use in the hydration system of this invention.

FIG. 3 shows a more detailed view of the hydration system of the present invention. As illustrated in FIG. 3, the reservoir 110 includes an optional hanger section 111. The hanger section 111, if included, typically comprises a plurality of reinforced holes. The hanger section 111 is designed so as to work in cooperation with various hooks, hangers, straps, or the like that may be included in the reservoir compartment 196 of the backpack 195, which, for example, pass through the reinforced holes to secure the reservoir 110 within the reservoir compartment 196.

Figure 6A:
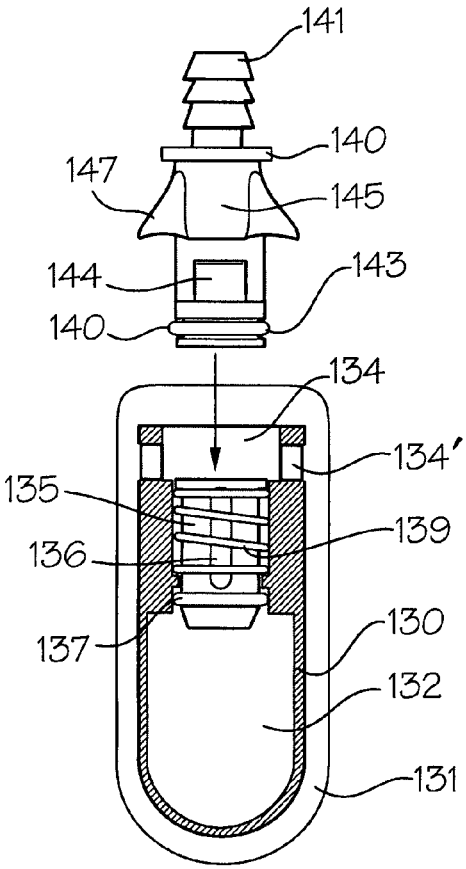
FIGS. 6A through 6C are more detailed, partial cross sectional views of the end fitting and port assembly of the present invention, illustrating the coupling interaction between the end fitting and the port assembly.
Figure 6B:
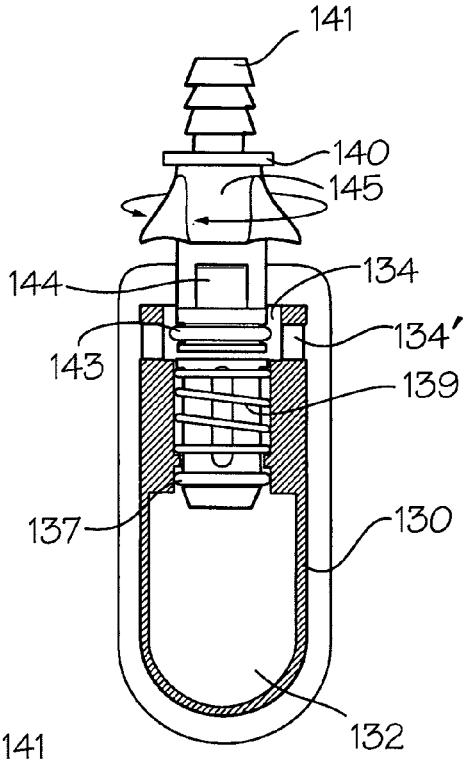
Figure 6C:
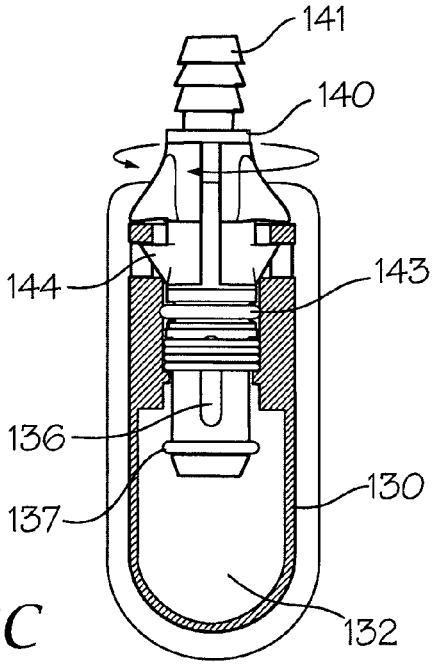

As further illustrated in FIG. 3, the delivery conduit 120 connects at one end to a port assembly 130 via a quick disconnect end fitting 140. As illustrated in FIGS. 6A through 6C, a valve stem 135 is arranged within port assembly 130 to prevent fluid contents from the interior of the reservoir 110 from flowing from the reservoir 110 when end fitting 140 is decoupled from the reservoir 110.

In various exemplary embodiments, the port assembly 130 is generally placed in fluid communication with the reservoir 110 at or near the bottom of the reservoir 110 to facilitate complete evacuation of its potable contents. However, it should be appreciated that the systems and methods of the present invention are able to operate regardless of the location of the port assembly 130.

As illustrated in greater detail in FIGS. 6A through 8, the port assembly 130 comprises at least some of a flange 131, a port opening 132, and recesses 134 having associated upper lips 134'. The flange 131 of the port assembly 130 is provided for fastening the reservoir port assembly 130 to the exterior or interior surface of the reservoir 110. In various exemplary embodiments, the flange 131 is heat welded or adhesively bonded to the reservoir 110. The port opening 132 is in communicating relationship with the interior of the reservoir 110, via a reservoir opening 118, such that fluid can flow into or out of the interior of the reservoir 110 through port opening 132.

A valve stem 135 is fitted within a portion of the port opening 132. The valve stem 135 includes a valve stem opening 136 and an o-ring 137. The valve stem 135 is positioned within the port opening 132 such that the valve stem 135 is spring biased, via a spring 139, to a closed position. When in the closed position, fluid is unable to flow through the valve stem opening 136.

The o-ring 137, if included, helps to improve the seal between the valve stem 135 and an interior of the port opening 132 to further insure that fluid does not flow through the valve stem opening 136 when valve stem 135 is in the closed position.

As also illustrated in greater detail in FIGS. 6A through 8, the end fitting 140 includes at least some of an end portion 140', one or more external barbs 141, and a rotatable coupling member 145. The external barbs 141 are formed so as to be inserted into the delivery conduit 120 and provide for frictional attachment of the end fitting 142 and the end of the delivery conduit 120.

The rotatable coupling member 145 is rotatably attached or coupled to the hollow end fitting 140. The rotatable coupling member 145 includes two or more flanges 144 that extend from the rotatable coupling member 145. One or more surface preparations 147 are included on the rotatable coupling member 145. In various exemplary embodiments, the surface preparations 147 include protrusions or other surface texturing that allows a user to more easily maintain a grip on the rotatable coupling member 145.

Figure 7A:
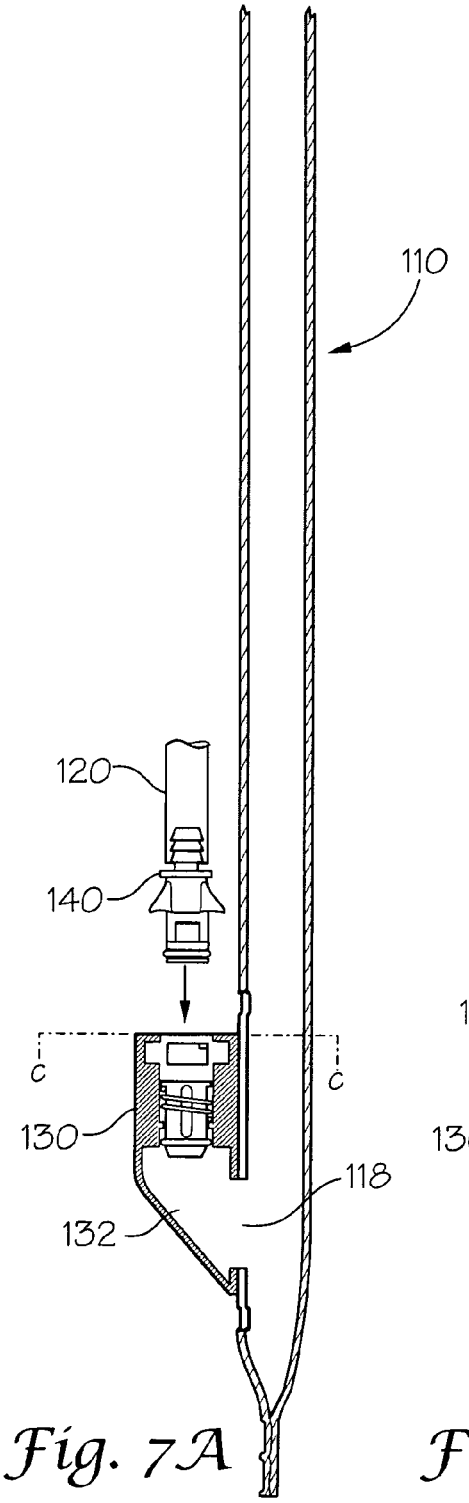
FIGS. 7A and 7B show more detailed, partial cross sectional views of the reservoir and port assembly of the present invention, illustrating the coupling interaction between the end fitting and the port assembly.

As illustrated in FIGS. 6A and 7A, when the end fitting 140 is decoupled from the port assembly 130, the port assembly 130 is maintained in a closed position (wherein the valve stem 135 is spring biased to a closed position). Spring 139, which is seated within port assembly 130, biases valve stem 135 towards a closed position to seat an o-ring 137 to prevent fluid from flowing from the reservoir 110.

Figure 7B:
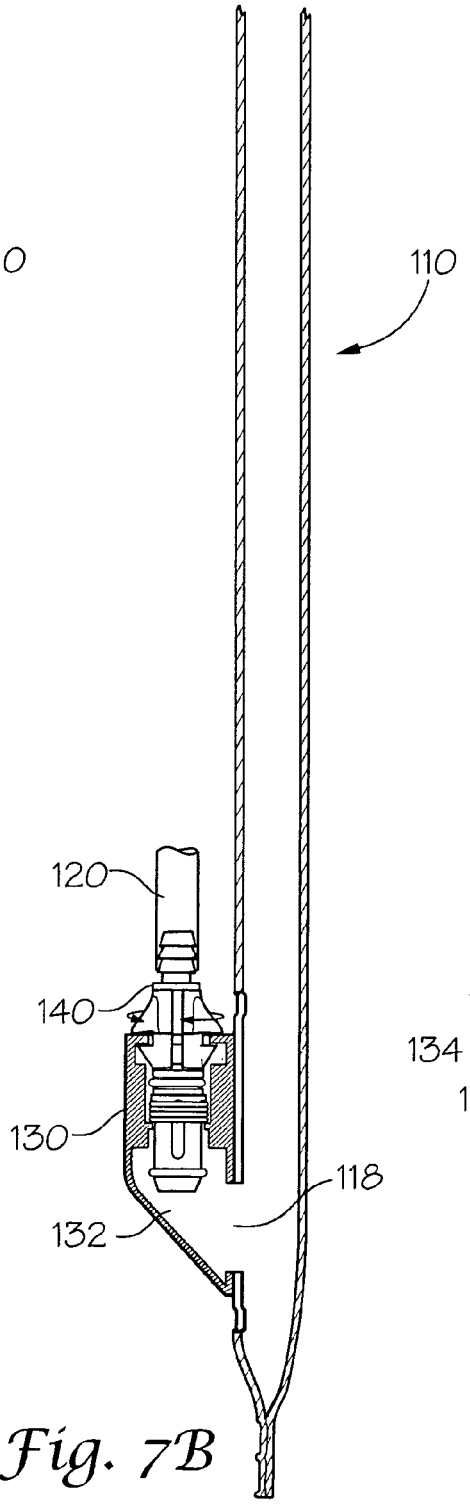
Figure 8:
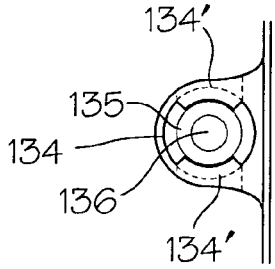
FIG. 8 shows a cross sectional view taken at line C-C, of FIG. 7B.

As illustrated in FIGS. 6B, 6C, and 7B, when the end fitting 140 is initially introduced into the port assembly 130, rotatable coupling member 145 is rotated such that the flanges 144 are aligned with the recesses 134. As the end fitting 140 is initially inserted into the port assembly 130, the end portion 140' makes contact with the valve stem 135.

As the end fitting 140 is urged into the port assembly 130, the contact between the end fitting 140 and the valve stem 135 acts to push the valve stem 135 further into the port assembly 130 and overcome the biasing force of the spring 139 to compress the spring 139 and move the valve stem 135 to an open position. Once the valve stem 135 is moved to the open position, by the end fitting 140 being sufficiently urged into the body of the port opening 132, the rotatable coupling member 145 is rotated such that the flanges 144 are aligned with the upper lips 134' and locked into the recesses 134. The biasing force created by spring 139 forces the flanges 144 against upper lips 134' to seat the end fitting 140. As can be readily realized by a skilled artisan, while the flanges 144 are appropriately aligned with the upper lips 134', the end fitting 140 is maintained within the port opening 132 and the valve stem 135 is maintained in the open position.

The rotatable coupling member 145 is rotated in an opposite direction to release the end fitting 140 from the reservoir port assembly 130 to disengage the end fitting 140. As the fitting 140 is removed from the port assembly 130, the valve stem 135 is spring biased to the closed position.

In the open position, the valve stem opening 136 is in fluid communication with the port opening 132, such that fluid from the interior of the reservoir 110 is able to freely flow into or out of the valve stem opening 136 in the valve stem 135, the port opening 132, the opening 118, and the reservoir 110.

In various exemplary embodiments, an o-ring 143 is included proximate an end portion 140' of the end fitting 140. The o-ring 143, if included, helps to improve the seal between the end fitting 140 and an interior of the port opening 132 to further insure that fluid does not escape from the port opening 132 and end fitting 140 when the port opening 132 and the end fitting 140 are in fluid communication.

Figure 9A:
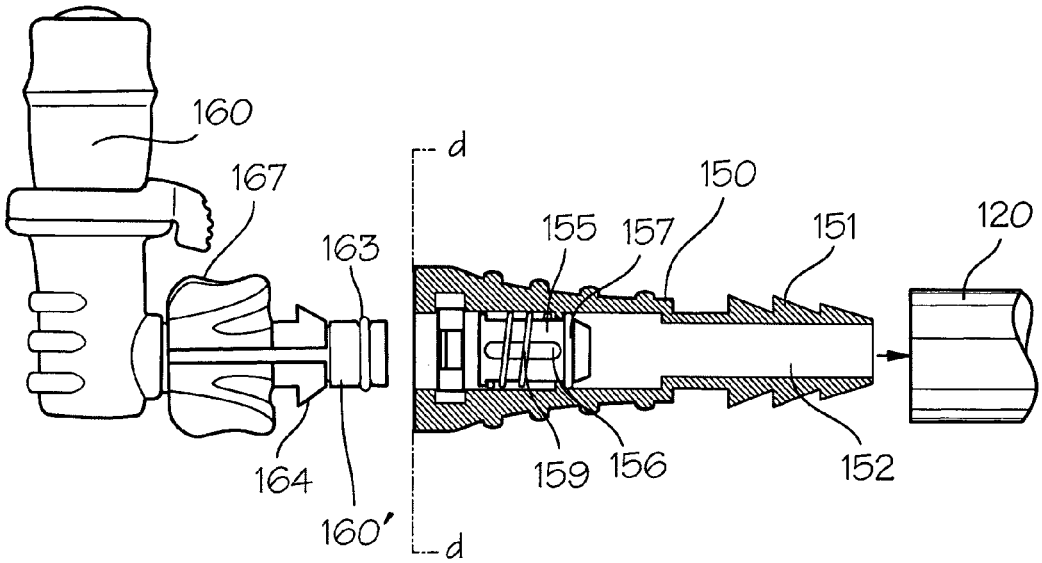
FIGS. 9A and 9B show more detailed, partial cross sectional views of the bite valve and port assembly of the present invention, illustrating the coupling interaction between the end fitting of the bite valve and the port assembly.
Figure 9B:
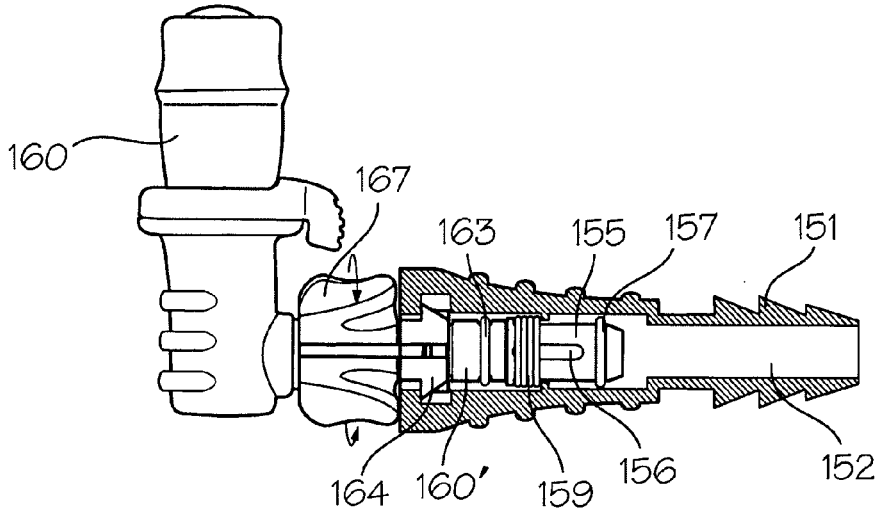
Figure 10:
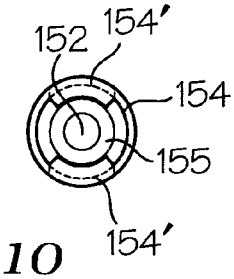
FIG. 10 shows a cross sectional view taken at line D-D, of FIG. 9A.

As illustrated in greater detail in FIGS. 9A through 10, the delivery conduit 120 connects to a bite valve 160 at an end distal from the end fitting 140, via a quick disconnect connector assembly 150. As illustrated in FIGS. 9A and 9B, a valve stem 155 is arranged within an opening 152 of the connector assembly 150 to prevent fluid contents from the interior of the delivery conduit 120 from flowing from the delivery conduit 120 when bite valve 160 is decoupled from the delivery conduit 120.

As illustrated in greater detail in FIGS. 9A through 10, the connector assembly 150 comprises at least some of at least one external barb 151, a connector opening 152, and recesses 154 having associated upper lips 154'. The at least external barbs 151 are formed so as to be inserted into the delivery conduit 120 and provide for frictional attachment of the connector assembly 150 and the end of the delivery conduit 120.

The connector opening 152 is in communicating relationship with the interior of the delivery conduit 120, such that fluid can flow into or out of the interior of the delivery conduit 120 through connector opening 152.

A valve stem 155 is fitted within a portion of the connector opening 152. The valve stem 155 includes a valve stem opening 156 and an o-ring 157. The valve stem 155 is positioned within the connector opening 152 such that the valve stem 155 is spring biased, via a spring 159, to a closed position. When in the closed position, fluid is unable to flow through the valve stem opening 156.

The o-ring 157, if included, helps to improve the seal between the valve stem 155 and an interior of the connector opening 152 to further insure that fluid does not flow through the valve stem opening 156 when valve stem 155 is in the closed position.

As also illustrated in greater detail in FIGS. 9A through 10, the bite valve 160 includes at least some of an end portion 160' and a rotatable coupling member 165. It should be appreciated that the bite valve 160 also includes a valve designed to be activated by the jaws and teeth of a user. Once activated, fluid is allowed to flow from the bite valve 160. Otherwise, the bite valve 160 is closed and prevents inadvertent draining of the reservoir 110.

The rotatable coupling member 165 is rotatably attached or coupled proximate the end portion 160' of the bite valve 160. The rotatable coupling member 165 includes two or more flanges 164 that extend from the rotatable coupling member 165. One or more surface preparations 167 are included on the rotatable coupling member 165. In various exemplary embodiments, the surface preparations 167 include protrusions or other surface texturing that allows a user to more easily maintain a grip on the rotatable coupling member 165.

As illustrated in FIG. 9A, when the bite valve 160 is decoupled from the connector assembly 150, the connector assembly 150 is maintained in a closed position (wherein the valve stem 155 is spring biased to a closed position). Spring 159, which is seated within the opening 152 of the connector assembly 150, biases valve stem 155 towards a closed position to seat an o-ring 157 to prevent fluid from flowing from the delivery conduit 120.

When the end portion 160' of the bite valve 160 is initially introduced into the connector assembly 150, rotatable coupling member 165 is rotated such that the flanges 164 are aligned with the recesses 154. As the bite valve 160 is initially inserted into the connector assembly 150, the end portion 160' makes contact with the valve stem 155.

As the bite valve 160 is urged into the connector assembly 150, the contact between the end portion 160' and the valve stem 155 acts to push the valve stem 155 further into the connector assembly 150 and overcome the biasing force of the spring 159 to compress the spring 159 and move the valve stem 155 to an open position.

As illustrated in FIG. 9B, when the valve stem 155 is moved to the open position, by the end portion 160' being sufficiently urged into the body of the connector opening 152, the rotatable coupling member 165 is rotated such that the flanges 164 are aligned with the upper lips 154' and locked into the recesses 154. The biasing force created by spring 159 forces the flanges 164 against upper lips 154' to seat the end portion 160'. As can be readily realized by a skilled artisan, while the flanges 164 are appropriately aligned with the upper lips 154', the end portion 160' is maintained within the connector opening 152 and the valve stem 155 is maintained in the open position.

The rotatable coupling member 165 is rotated in an opposite direction to release the end fitting 160 from the reservoir connector assembly 150 to disengage the end fitting 160. As the fitting 160 is removed from the connector assembly 150, the valve stem 155 is spring biased to the closed position.

The process is reversed to disengage the bite valve 160. As the end portion 160' of the bite valve 160 is removed from the connector assembly 150, the valve stem 155 is spring biased to the closed position.

In the open position, the valve stem opening 156 is in fluid communication with the connector opening 152, such that fluid from the interior of the delivery conduit 120 is able to freely flow into or out of the valve stem opening 156 in the valve stem 155, the connector opening 152, and the delivery conduit 120.

In various exemplary embodiments, an o-ring 163 is included proximate an end portion 160' of the bite valve 160. The o-ring 163, if included, helps to improve the seal between the end portion 160' and an interior of the connector opening 152 to further insure that fluid does not escape from the connector opening 152 and end portion 160' when the connector opening 152 and the bite valve 160 are in fluid communication.

It should be appreciated that when both the bite valve 160 and the port assembly 130 are appropriately connected, via the delivery conduit 120, fluid is able to pass freely through the members of the hydration system. When disconnected, at least the portion of the coupling combination that is directly disconnected is shut-off or closed-off to flow. It is possible, however, to configure either valve portion with manual valve-release features to allow a user to override valve closure function in order to drain fluid contents and/or purge air from the delivery conduit 120 or reservoir 110.

In certain exemplary embodiments, the bite valve 160 can be replaced by a fill port device having an appropriate coupler such that, upon engagement with the port assembly 130, the fill port enables fluid to be conveniently introduced into the delivery conduit 120 and port assembly 130 form, for example, a hose, faucet, spigot, spout, or the like, to fill the reservoir 110.

Figure 4A:
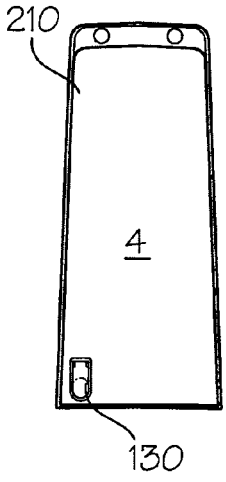
FIGS. 4A through 4D depict various exemplary reservoirs having different arrangements and positions of the reservoir ports and optional multiple compartments of the reservoir, according to this invention.
Figure 4B:
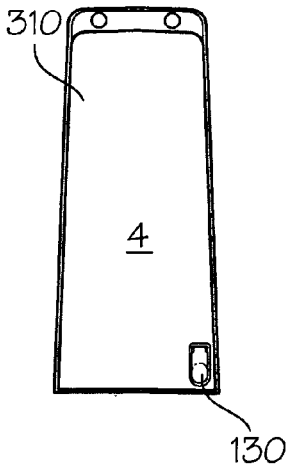

Moving to FIGS. 4A through 4D, 4A through 4D depict various exemplary reservoirs having different arrangements and positions of the port assembly 130 and optional compartments of the reservoir, according to this invention. As illustrated in FIG. 4A, the reservoir 210 includes the port assembly 130 positioned proximate a lower left corner of the reservoir 210. FIG. 4B shows a reservoir 310, wherein the port assembly 130 is positioned proximate a lower right corner of the reservoir 310.

Figure 4C:
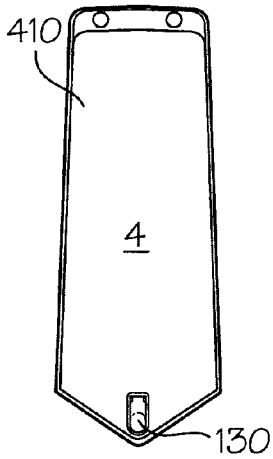

In FIG. 4C, the reservoir 410 includes sloped edges that effectively drain the fluid contents of the reservoir 410 towards the port assembly 130.

Figure 4D:
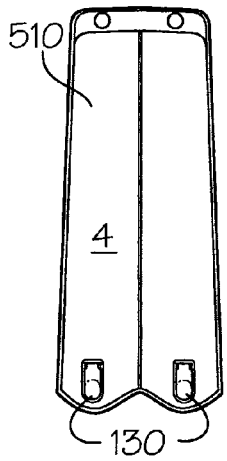

FIG. 4D shows a reservoir 510 that includes two separate compartments for holding liquid. As illustrated, each separate compartment includes its own port assembly 130. It should be appreciated that while each separate compartment may includes sloped edges, as illustrated, each compartment may includes a sloped, rounded, flat, or other desirable profile. Likewise, the port assembly for each separate compartment may be located proximate a center for side of each compartment.

Figure 5A:
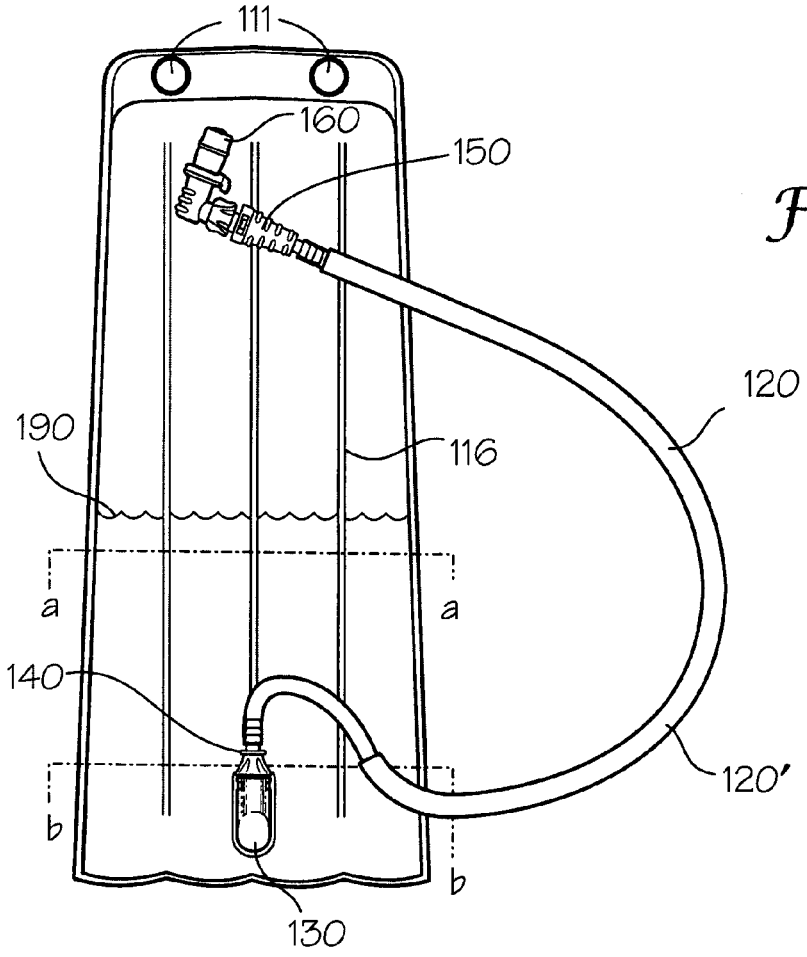
FIG. 5A shows a front plan view of an exemplary reservoir that includes baffles for retaining the shape of the reservoir.
Figure 5B:
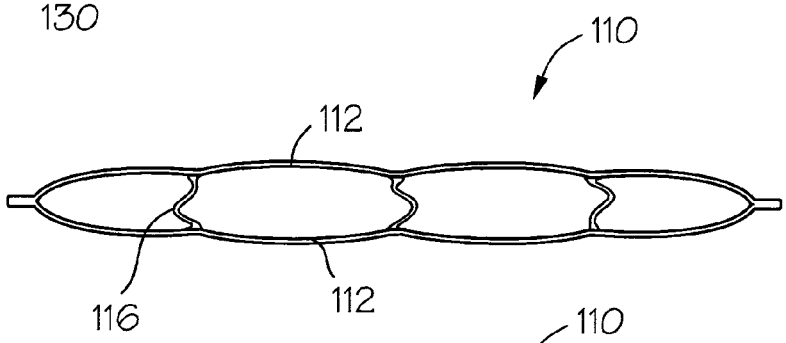
FIGS. 5B and 5C are cross sectional views of the reservoir of FIG. 5A taken at lines A-A and B-B, respectively.
Figure 5C:
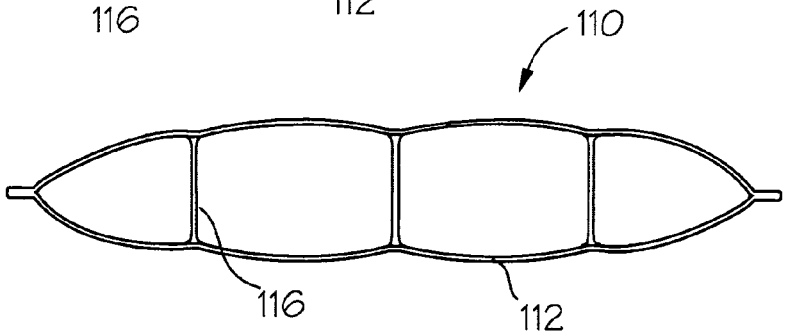

FIG. 5A shows a front plan view of an exemplary reservoir that includes baffles for retaining the shape of the reservoir, while FIGS. 5B and 5C show cross sectional views of the reservoir of FIG. 5A taken at lines A-A and B-B, respectively. As illustrated in FIGS. 5A through 5C, the baffles 116 link portions of the side walls 112 of the reservoir 110 to aid in maintaining the overall shape of the reservoir 110, such that the side walls 112 do not balloon outwardly when the reservoir 110 is filled with a fluid 190 or sag as the fluid 190 is drained from the reservoir 110. As can be seen in FIGS. 5B and 5C, the baffles 116 are flexible such that the side walls 112 collapse towards one another as the fluid 190 within the reservoir 110 is drained.

Figure 11:
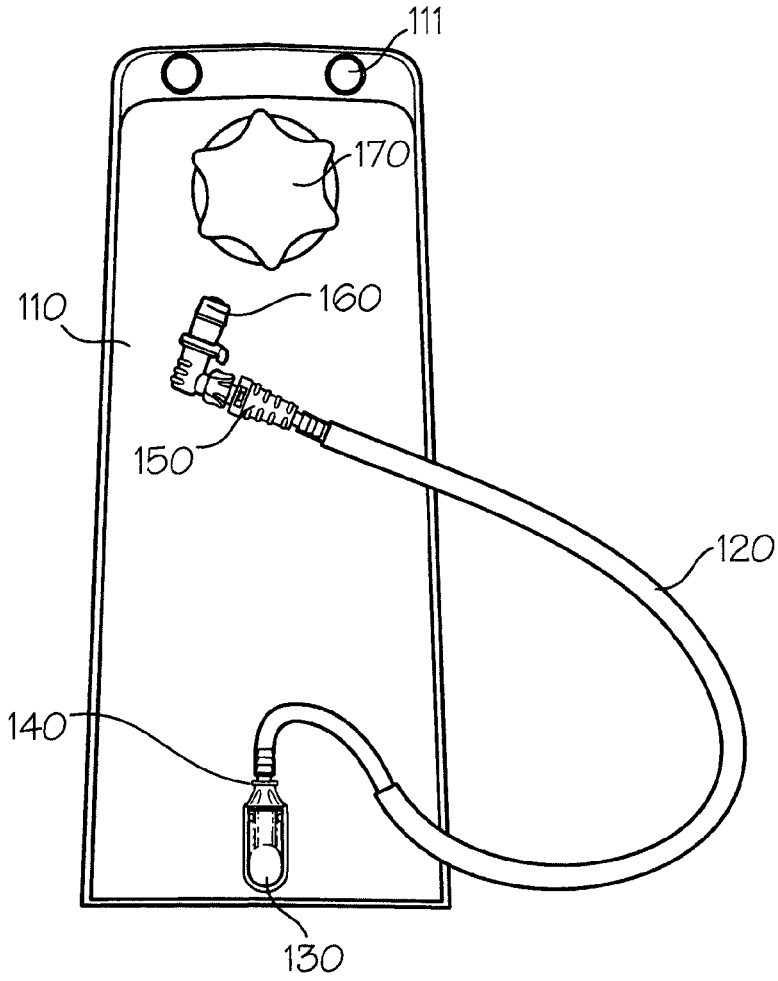
FIG. 11 shows a plan view of an exemplary reservoir for use in the hydration system of this invention, where the reservoir includes a removable fill cap.

FIG. 11 shows a plan view of an exemplary reservoir for use in the hydration system of this invention, where the reservoir 110 includes a removable fill cap 170. In this manner, the reservoir 110 can be filled or refilled via a sealable or resealable opening. Thus, when a liquid is consumed from the reservoir, the reservoir can be refilled.

It should be appreciated that the fill cap 170 may comprise any appropriate screw-type, snap, or press-fit, baffle, or another structure that is compatible with the sealable or resealable opening.

Figure 12B:
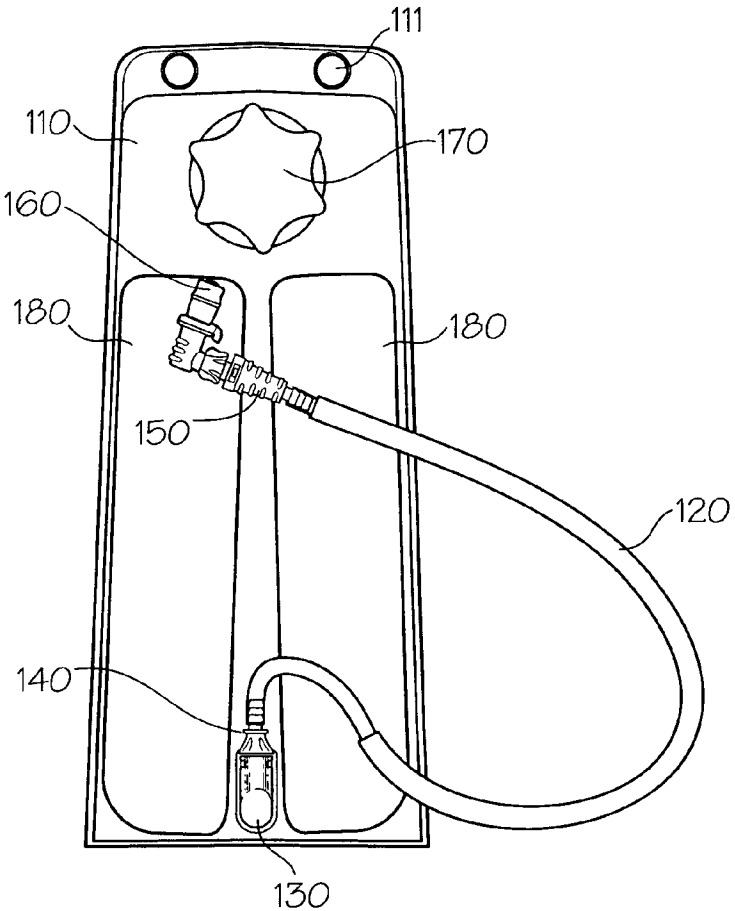
FIG. 12B shows a plan view of an exemplary reservoir for use in the hydration system of this invention, where the reservoir includes at least one thermal capacitance medium and a removable fill cap.
Figure 12A:
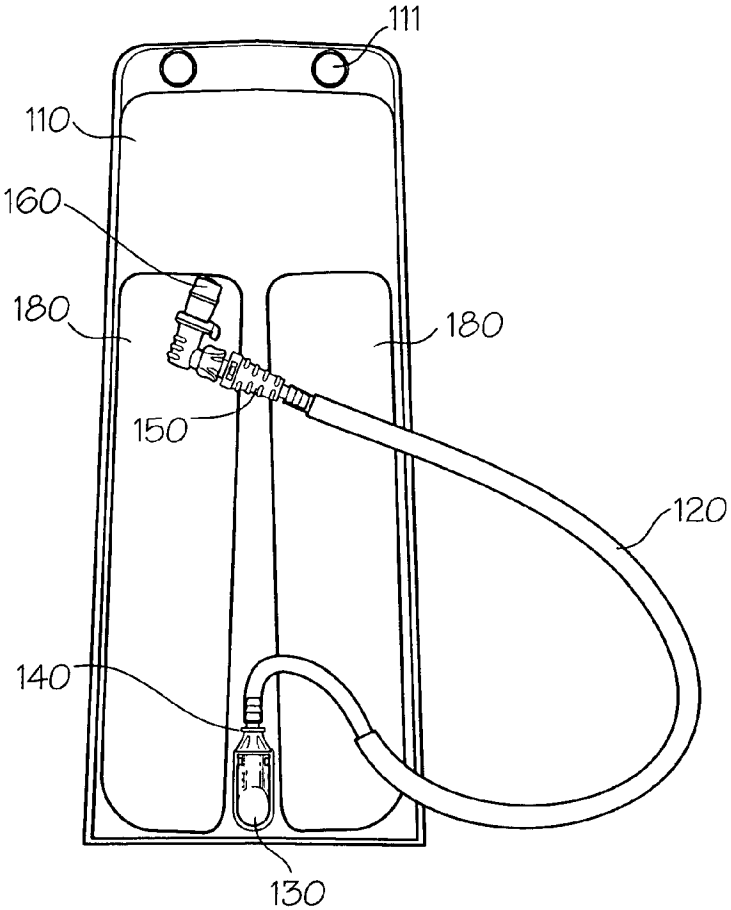
FIG. 12A shows a plan view of an exemplary reservoir for use in the hydration system of this invention, where the reservoir includes at least one thermal capacitance medium.

FIGS. 12A and 12B show plan views of two exemplary reservoirs for use in the hydration system of this invention, wherein the reservoirs includes at least one thermal capacitance medium reservoir 180. As shown in FIG. 12A, the at least one thermal capacitance medium reservoir 180 is included in a reservoir 110 that is designed to be a single use reservoir or, alternatively, to be filled or refilled via the port assembly 130.

As shown in FIG. 12B, the at least one thermal capacitance medium reservoir 180 is included in a reservoir 110 that is designed to be filled or refilled via a sealable or resealable opening having a fill 170.

Suitable integrally cooled (or heated) thermal capacitance medium reservoirs 180 may be used to implement the present invention. In any case, thermal capacitance medium reservoir (s) 180 are to be filled with an appropriate thermal capacitance medium.

In various exemplary, non-limiting embodiments, the thermal capacitance medium comprises a thermal capacitance medium as described in U.S. patent application Ser. No. 10/043,657, entitled Hydration Pouch with Integral Thermal Medium, filed Jan. 8, 2002, the disclosure of which is incorporated herein by reference.

In various exemplary embodiments, the thermal capacitance medium may comprise water, a gel, or other material that may be effectively chilled and/or heated. The material or materials chosen may have a high specific heat or heat capacity in order to best cool and/or heat or maintain a low or a high temperature of fluid within the reservoir 110. An exemplary thermal capacitance medium for cooling comprises a non-toxic refrigerant gel of conventional formulation. Compositions that may be suitable for the thermal capacitance medium include water and propylene glycol or a cellulose ether, as used, for example, in commercially available gel packs for cooling and/or heating.

Figure 13A:
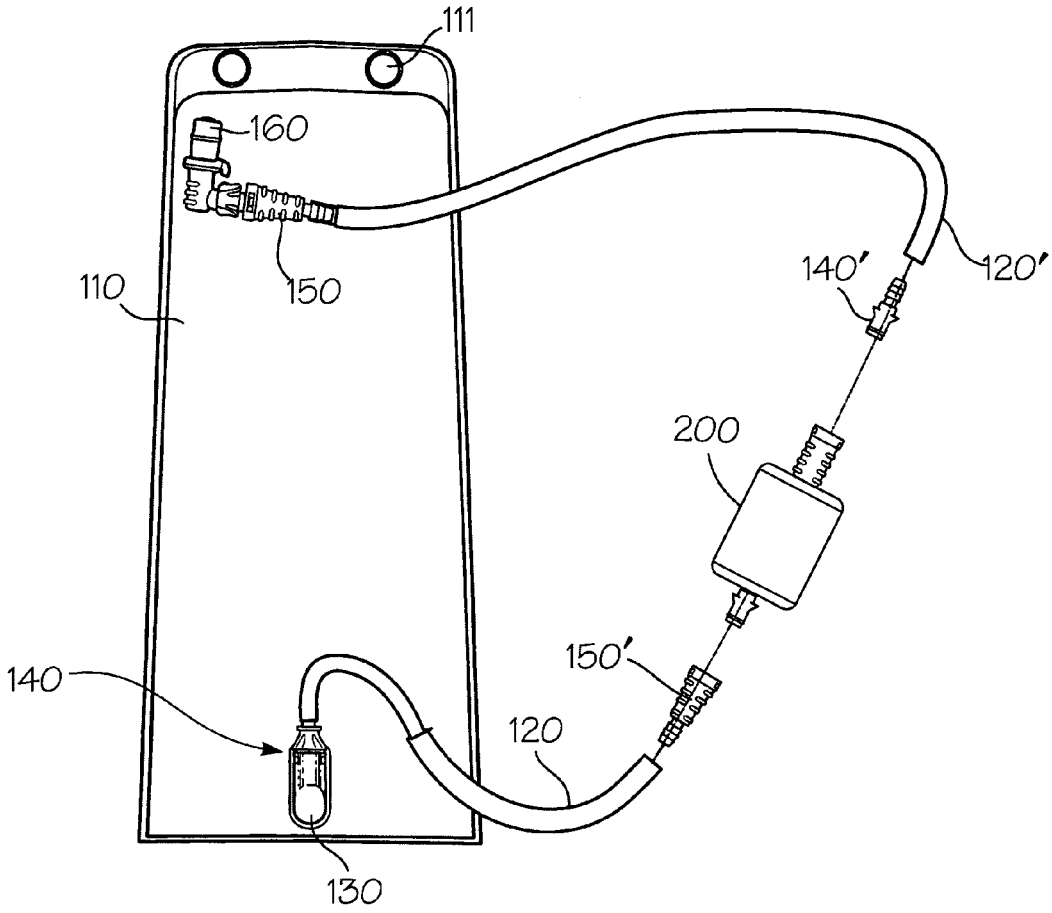
FIG. 13A shows a plan view of an exemplary delivery conduit for use in the hydration system of this invention, where the delivery conduit is capable of receiving an additional device in-line with the delivery conduit.

FIG. 13A shows a plan view of an exemplary delivery conduit for use in the hydration system of this invention, where the delivery conduit is capable of receiving an additional device in-line with the delivery conduit. As shown in FIG. 13A, an end fitting 140' and a connector assembly 150' are included in line with the delivery conduit 120.

It should be appreciated that the end fitting 140' and the connector assembly 150' correspond to and operate similarly to the end fitting 140 and the connector assembly 150, as described herein. Inclusion of the end fitting 140' and the connector assembly 150' allows items such as a device 200 to be connected in line with the delivery conduit 120. It should be appreciated that the device 200 may comprise any filter, purification device, infusion system, or the like. It should also be appreciated that the device 200 includes or incorporates an appropriate end fitting 140" for releasable connection to the connector assembly 150' and an appropriate connector assembly 150" for releasable connection to the end fitting 140'.

Figure 13B:
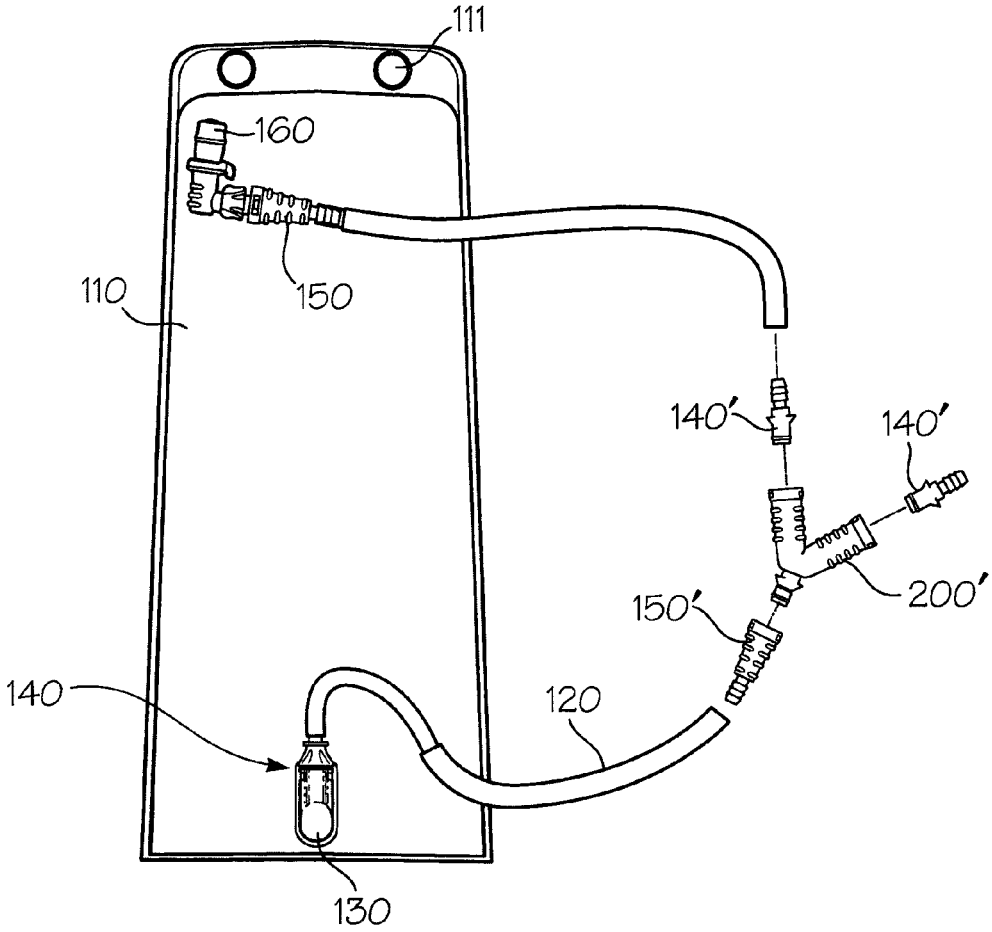
FIG. 13B shows a plan view of an exemplary delivery conduit for use in the hydration system of this invention, where the delivery conduit is capable of receiving a multiplying connector in-line with the delivery conduit.

FIG. 13B shows a plan view of an exemplary delivery conduit for use in the hydration system of this invention, where the delivery conduit is capable of receiving a multiplying connector in-line with the delivery conduit 120. As illustrated in FIG. 13B, the device 200 of FIG. 13A is replaced with a multiplying coupler 200'. The multiplying coupler 200' may include any number of appropriate connector assemblies are end fittings and allows other corresponding end fittings are connector assemblies to be coupled, in-line, with the delivery conduit 120.

In certain exemplary embodiments, the multiplying connector includes a permeable membrane that can be re-sealably punctured to allow certain chemicals or additives to be introduced into the fluid.

The multiplying connector may include a stopcock or valve that allows fluid from a particular branch of the multiplying connector to be directed into a particular connector or branch.

Additionally, fluid from multiple reservoirs can be directed into a single delivery conduit 120.

Though the invention has been described in reference to several examples, optionally incorporating various features, the invention is not to be limited to the set ups described or indicated as contemplated with respect to each variation. It is to be understood that the breadth of the present invention is to be limited only by the literal or equitable scope of the following claims.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, is intended to be illustrative, not limiting. Various changes, modifications, and/or adaptations may be made without departing from the spirit and scope of this invention.

We claim:

1. A hydration system comprising:

a flexible reservoir coupled to a self-sealing port assembly, wherein an interior of the flexible reservoir is in fluid communication with the port assembly, via an outlet;

a delivery conduit having two ends, wherein a first end of the delivery conduit is coupled to a self-sealing connector assembly and wherein a second end of the delivery conduit is coupled to a first end fitting;

wherein the connector assembly is open to allow fluid to flow from the delivery conduit if a second end fitting is positively coupled to the connector assembly and the connector assembly is closed to prevent fluid from flowing from the delivery conduit if the second end fitting is decoupled from the connector assembly, wherein the second end fitting is positively coupled to the connector assembly when the second end fitting cannot be decoupled from the connector assembly if the second end fitting is merely pulled relative to the connector assembly; and wherein the port assembly is open to allow fluid to flow from the flexible reservoir if the first end fitting of the delivery conduit is positively coupled to the port assembly, and the port assembly is closed to prevent fluid from flowing from the flexible reservoir if the first end fitting of the delivery conduit is decoupled from the port assembly, wherein the first end fitting of the delivery conduit is positively coupled to the port assembly when the first end fitting of the delivery conduit cannot be decoupled from the port assembly if the first end fitting of the delivery conduit is merely pulled relative to the port assembly.

2. The system of claim 1, wherein the flexible reservoir includes at least one thermal capacitance medium reservoir.

3. The system of claim 1, wherein a user actuatable valve is removably coupled, via the second end fitting, to the connector assembly.

4. The hydration system of claim 1, wherein the outlet is positioned proximate a bottom of the flexible reservoir.

5. The hydration system of claim 1 wherein the flexible reservoir includes one or more baffles for shape retention.

6. The system of claim 3, wherein the user actuatable valve is a bite valve.

7. The system of claim 1, wherein a fill port device is removably coupled, via the second end fitting, to the connector assembly.

8. The system of claim 1, wherein a hose is removably coupled, via the second end fitting, to the connector assembly.

9. The system of claim 1, wherein a faucet, spigot, or spout is removably coupled, via the second end fitting, to the connector assembly.

* * * * *